United States Patent [19]

Schuster

[11] 4,342,545

[45] Aug. 3, 1982

[54] VARIABLE DISPLACEMENT PUMP

[75] Inventor: David A. Schuster, New Boston, Mich.

[73] Assignee: General Motors Corporation, Detroit, Mich.

[21] Appl. No.: 110,044

[22] Filed: Jan. 7, 1980

Related U.S. Application Data

[63] Continuation of Ser. No. 927,507, Jul. 24, 1978, abandoned.

[51] Int. Cl.[3] ..... F04C 15/02; F04C 29/08

[52] U.S. Cl. ..... 418/26; 418/27; 418/30

[58] Field of Search ..... 418/24–27, 418/30

[56] References Cited

U.S. PATENT DOCUMENTS 2,433,484 12/1947 Roth ..... 418/26

2,635,551 4/1953 De Lancey ..... 418/30

2,811,926 11/1957 Robinson, Jr. ..... 418/26

3,656,869 4/1972 Leonard ..... 418/30

*Primary Examiner*—John J. Vrablik

*Attorney, Agent, or Firm*—Donald F. Scherer

[57] ABSTRACT

A variable displacement vane type pump having a pivotally mounted ring member controllable to vary the eccentricity between the rotor and the ring thus controlling the pump displacement. The ring is positioned on the pivot such that the center thereof is always located in one quadrant relative to axes through the pivot point and the center of the pump rotor to continually maintain the net ring reaction force, due to internal pressure, directed to one side of the pivot connection in opposition to the displacement control pressure, which is impressed on a portion of the outer surface of the ring, whereby control stability throughout the displacement range is improved.

2 Claims, 3 Drawing Figures

VARIABLE DISPLACEMENT PUMP

This is a continuation of application Ser. No. 927,507, filed July 24, 1978, now abandoned.

This invention relates to variable displacement pumps and more particularly to vane type pumps having a pivoting ring.

The present invention is found to be most useful in automatic transmission controls to provide an increase in efficiency of the transmission system. Variable displacement pumps have been used previously in transmission control systems, however, these prior art devices have generally been of the sliding ring type in which the control therof is maintained by a spring and control pressures in the chambers on both sides of the sliding ring. The prior art pivoting ring type variable displacement pumps have not satisfactorily overcome the control instability problem inherent in such pumps without the use of very strong control springs or the use of dual chamber control systems. The present invention overcomes the inherent instability of such pumps by maintaining the net internal reaction force on the pivoting ring in a manner such that the resultant moment about the pivoting axis is in one direction in opposition to the control pressure.

It is an object of this invention to provide an improved variable displacement vane pump having a single control chamber and a directionally controlled internally generated reaction force.

It is another object of this invention to provide an improved variable displacement vane pump having a pivotally controlled ring operated on by an internally generated pressure reaction force directed to always establish a moment in one direction about the pivot point of the ring in opposition to an externally supplied control pressure.

These and other objects and advantages of the present invention will be more apparent from the following description and drawings in which.

Figure 1:
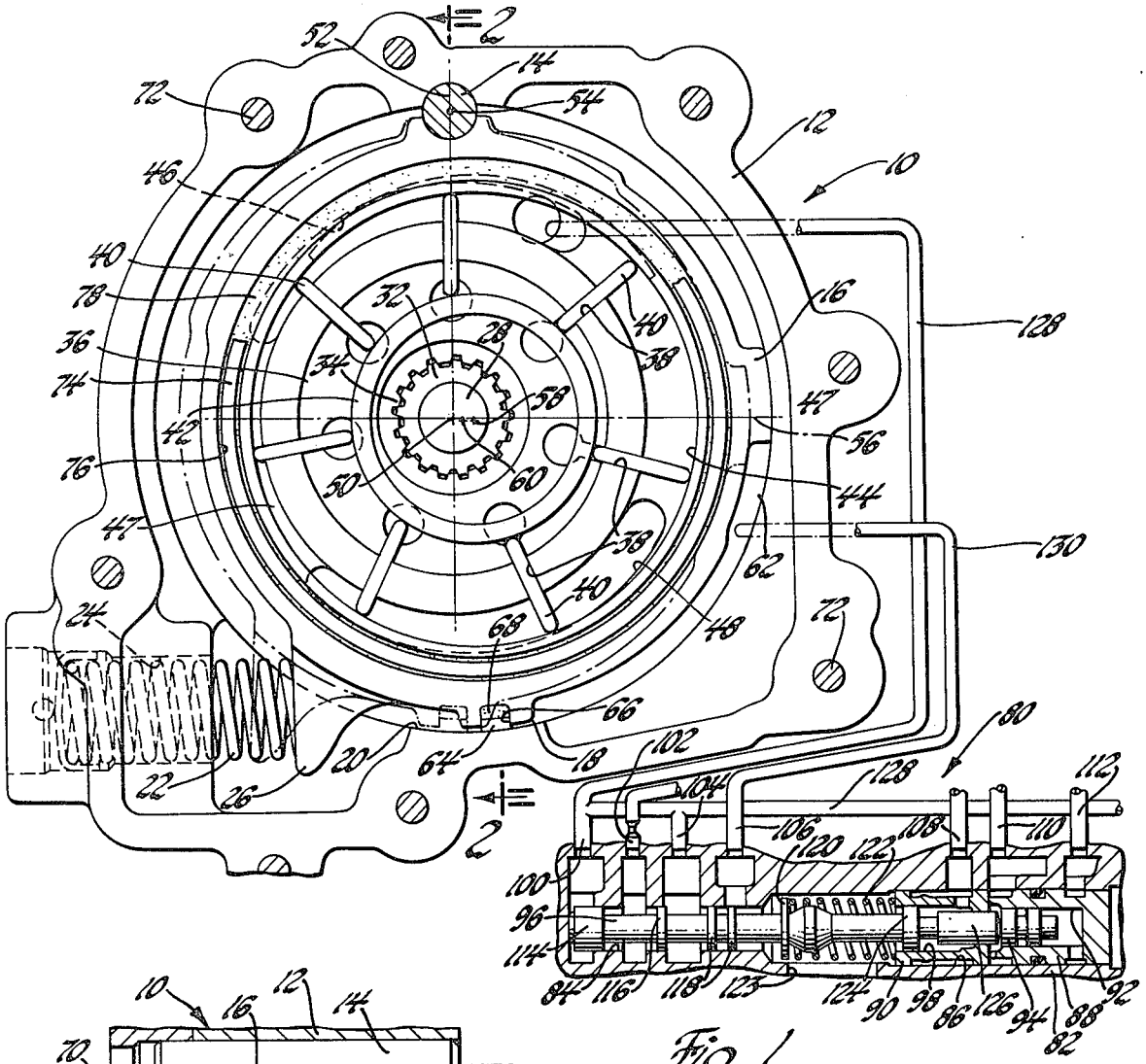
FIG. 1 is an elevational view of a pump incorporating the present invention with the pump cover removed.
Figure 2:
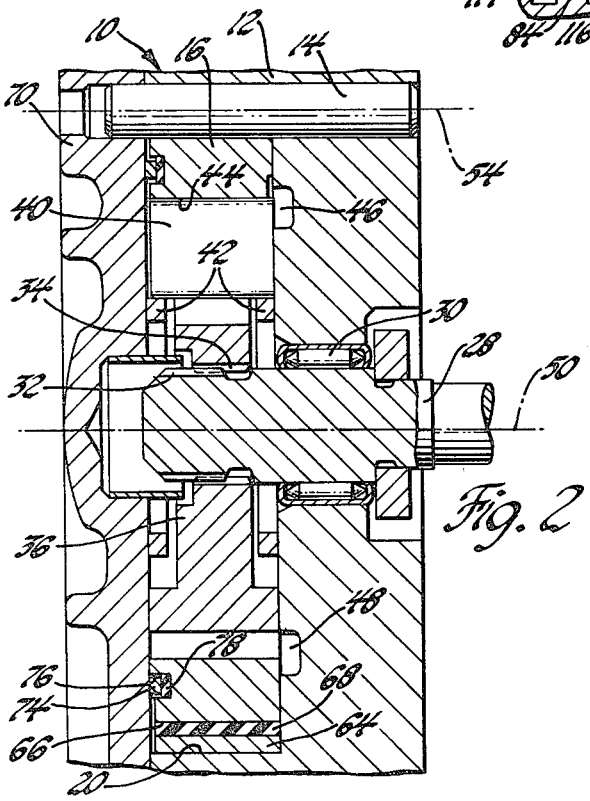
FIG. 2 is a sectional view taken along line 2—2 in FIG. 1.

There is seen in FIGS. 1 and 2 a variable displacement pump, generally designated 10, having a housing 12 in which is secured a pivot pin 14. A ring member 16 is pivotally mounted on the pin 14 and slidably supported at 18 on a surface 20 formed in the housing 12. The ring 16 is urged to the position shown in solid lines by a compression spring 22 which is disposed in a cylindrical opening 24 formed in the housing 12 and abuts a lug 26 formed on the ring 16.

A pump drive shaft 28 is rotatably mounted in the housing 12 through a needle bearing 30, which drive shaft 28 has a splined end 32 drivingly connected to a spline 34 formed on a pump rotor 36. The pump rotor 36 has a plurality of radial slots 38 formed therein in each of which slots 38 is slidably disposed a vane member 40. The vanes 40 are urged outwardly by a pair of vane control rings 42 and centrifugal force toward a cylindrical surface 44 formed on the ring 16.

The housing 12 has formed therein a pair of kidney shaped ports 46 and 48 which provide discharge and inlet ports, respectively, for the pump 10. A plurality of chambers 47 are formed by the vanes 40, rotor 36 and surface 44. The chambers 47 rotate with rotor 36 and expand and contract during rotation, as is well-known in vane type pumps. The inlet port 48 accepts fluid from a reservoir, not shown, and passes the fluid to the chambers 47. The vanes 40 carry the fluid in the chambers 47 from the inlet port 48 to the discharge port 46. As can be seen in FIG. 1, if the pump rotor 36 is rotating in a counterclockwise direction, the chambers 47 are continually expanding, to take in fluid, in the area of inlet port 48 and are contracting, to discharge fluid, in the area of the discharge port 46.

The drive shaft 28 has a central axis 50 which is intersected by an axis 52 passing through the central axis 54 of the pivot pin 14. The axes 52 and 50 are intersected by an axis 56 which is disposed at right angles to the axis 52. In the position shown by solid lines in FIG. 1, the center of the cylindrical surface 44 is located at 58 and when the pump is moved to the minimum displacement, as shown by phantom lines, the center of cylindrical surface 44 is located at 60.

The position of ring 16 is established by control pressure in a chamber 62 which extends about the outer circumference of ring 16 from pivot pin 14 to a seal member 64 disposed in a groove 66 formed in the ring 16. The seal member 64 is urged outwardly against surface 20 by a resilient backing member 68. Thus, the control fluid is confined to what is essentially a semicylindrical chamber. The spring 22 acts in opposition to the control fluid in chamber 62 such that as the pressure in control chamber 62 increases, the pump ring 16 will be moved clockwise about pivot pin 14. The left face, as seen in FIG. 2, of the ring 16, rotor 36 and chambers 47 are closed by a cover 70 which is secured to the housing 12 by a plurality of fasteners 72. Leakage from the chambers 47 radially outwardly past the cover 70 is prevented by a seal ring 74 disposed in a groove 76 formed in the ring 16 and urged toward the cover by a resilient backing ring 78. Any fluid leakage which occurs in a radially inward direction passes through the bearing 30 and combines with the converter return fluid, not shown.

The fluid pressure in control chamber 62 is supplied by a regulator valve generally designated 80, which includes a housing 82 having a small diameter bore 84 at the left end thereof and a large diameter bore 86 at the right end thereof. A pair of control plugs 88 and 90 are disposed in the bore 86. The plug 88 has a central bore 92 in which is slidably disposed a plug valve 94. A regulator valve spool 96 is slidably disposed in the bore 84 and in a stepped bore 98 formed in the plug 90. The housing 82 has formed therein a plurality of ports 100, 102, 104, 106, 108, 110 and 112. The ports 100 through 106 are in fluid communication with the bore 84, the port 108 is in fluid communication with bore 98, the port 110 is in fluid communication with the space between plugs 88 and 90, and therefore with the right end of valve spool 96, and the port 112 is in fluid communication with the bore 92 and therefore with the ring end of plug valve 94. The valve spool 96 has formed thereon a plurality of spaced equal diameter lands 114, 116 and 118 and a larger diameter land 120. The land 120 serves as a spring weight for a compression spring 122 disposed between the plug 90 and land 120 to urge the valve spool 96 to the left, as viewed in FIG. 1. The area of spring 122 is open to the reservoir through an opening 123. The valve spool 96 also has a large diameter land 124 and a small diameter land 126 which are slidably disposed in the stepped bore 98 of plug 90. The lands 124 and 126 can be formed on a separate valve spool, if desired.

The land 114 prevents fluid communication between ports 100 and 102, the land 116 provides controlled fluid communication between ports 104 and 102, and the valve land 118 provides controlled fluid communication between ports 104 and 105 and between port 106 and opening 123. The ports 100 and 104 are interconnected by a line pressure passage 128 which is in fluid communication with the discharge port 46 of pump 10 and therefore subject to the output pressure of pump 10 to supply pressurized fluid to a conventional transmission and control, not shown. The port 102 is in fluid communication with a conventional torque converter, not shown, and the port 106 is in fluid communication with the through passage 130 with the control chamber 62. The ports 108, 110 and 112 are connected through passages to the transmission control system and receive signals for reverse boost, intermediate boost and TV boost, respectively. The use of such boost signals is well-known to those skilled in the art of transmission controls. These boost pressures, as is known, assist the spring 122 to establish control pressure levels with the passage 128 in accordance with the drive range selected and the torque requirement of the vehicle.

The fluid pressure in passage 128 acts on the left end of land 114 to urge the valve spool 96 to the right against spring 122 and whatever boost pressure is present. When the fluid pressure in passage 128 is sufficient to move the valve spool 96 to the right, valve land 116 permits fluid flow from port 104 to port 102 so that the torque converter is supplied with fluid pressure. Upon further movement of the valve spool 96 to the right, valve land 118 will permit fluid communication between ports 104 and 106 and therefore will direct fluid pressure to the control chamber 62. The port 106 is opened by valve land 118 when the pump is supplying more fluid than is required by the transmission. Accordingly, at this time, the pump displacement is to be decreased. As the pressure is developed in chamber 62, the pump ring 16 will pivot about pin 14 in a clockwise direction against spring 22 thereby reducing the eccentricity between the central axis 50 of rotor 36 and the central axis of the cylindrical surface 44. Thus, the central axis of cylindrical surface 44 will be moved from position 58 toward position 60. When the axis reaches the position 60, the minimum pump displacement has been achieved and the fluid supplied at this point is sufficient to satisfy torque converter flow requirements, transmission lubrication requirements and leakage which occurs in the system. If system pressure should decrease, the valve spool 96 moves to the left to connect port 106, and therefore chamber 62, to the opening 123 thus relieving the pressure in chamber 62 so that the spring 22 will move the ring 16 counterclockwise to increase pump displacement.

Figure 3:
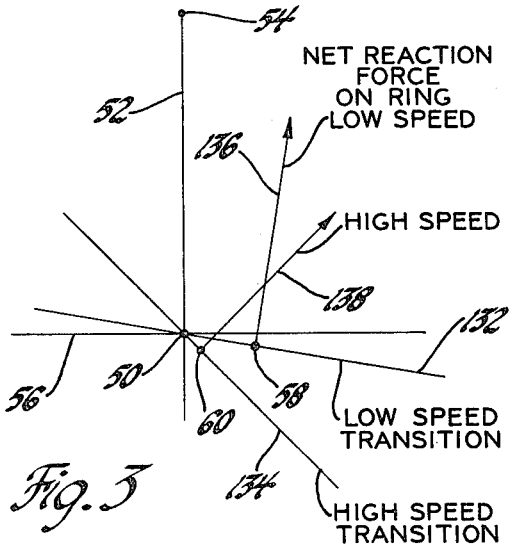
FIG. 3 is a diagrammatic representation of the reaction force on the pump ring.

Under most operating conditions, the axis of cylindrical surface 44 will be at position 58 during low speed conditions and at position 60 during high speed conditions. As the vanes 40 are rotated from the inlet port 48 to discharge port 46 and vice versa, a pressure transition takes place with the chambers 47. The pressure transition occurs along a line which passes through the central axis 50 of rotor 36 and the axis of cylindrical surface 44. At low speeds this transition line is represented by line 132 in FIG. 3, and at high speeds by line 134, in FIG. 3. Since the cylindrical surface 44 is subjected to the internal pressure generation in chambers 47, the ring is inherently unbalanced during operation. The net resultant reaction force due to the internal pressure generation passes through the central axis of cylindrical surface 44 normal to the pressure transition line. As shown in FIG. 3, the net reaction force on the ring at low speeds is in the direction of arrow 136 and at high speeds is in the direction of arrow 138. It will be appreciated, from FIG. 3, that these reaction forces alwasy provide a counterclockwise moment about axis 54 which is in opposition to the clockwise moment generated by the control pressure in chamber 62. It should also be noted from FIG. 3 that the net reaction force at the central axis of the cylindrical surface 44 is always confined to the lower right hand quadrant formed by the perpendicular axes 52 and 56.

Prior art pivoting ring pumps have been designed such that the central axis of the pivoting ring is aligned with the center of the rotor and the center of the pivot pin at the mid-position of pump displacement. Quite obviously, in these types of pump the net resultant force must therefore establish a moment about the pivot pin which changes direction as the pump passes through the midpoint of its displacement. Other pivoting type vane pumps have been designed such that the central axis of the ring passes from the upper right hand quadrant to the lower right hand quadrant of the diagram shown at FIG. 3, which also results in a reversal of the resultant moment about the pivot pin 14.

As will be appreciated from the foregoing discussion, the present invention overcomes the moment reversal which occurs in the prior art devices thereby substantially improving the control stability of pivoting ring type vane pumps.

Obviously, many modifications and variations of the present invention are possible in light of the above teaching. It is therefore to be understood, that within the scope of the appended claims, the invention may be practiced otherwise than as specifically described.

The embodiments of the invention in which an exclusive property or privilege is claimed are defined as follows:

1. A variable displacement vane pump comprising; a housing; inlet and discharge ports formed in said housing; a drive shaft rotatably mounted in said housing; a rotor driven by said drive shaft and coaxially aligned therewith; a plurality of radially extending vanes slidably disposed in said rotor; pivot means disposed in said housing; a ring member pivotally disposed on said pivot means in said housing and cooperating with said housing to form a displacement control chamber including wall means for positioning said ring member, said ring having a central axis eccentric to the axis of said rotor, said ring cooperating with said rotor and vanes to form a plurality of pumping chambers that are successively connected to said inlet aand discharge ports, fluid in said chambers creating an interal pressure force adjacent said discharge port which force is directed to establish a moment continuously in one direction on said ring about said pivot means; spring means acting on said ring member and urging said ring member in said one direction; and pressure control valve means for pressurizing said control chmber to establish a controlled moment on said ring about said pivot means in a direction opposite to the first mentioned moment, said controlled moment being cooperable with said spring means and said wall means to control the displacement of said pump by controlling the pivotal position of the center of the ring within a quadrant defined by intersecting perpendicular lines one of which intersects the axis of said rotor and the other of which intersects the axes of both the rotor and the pivot means, said quadrant being remote from and exclusive of the pivot means, and the center of said ring being continually noncoincident to either of the intersecting perpendicular lines defining said quadrant.

2. A variable displacement vane pump comprising; a housing; inlet and discharge ports formed in said housing; a drive shaft rotatably mounted in said housing; a rotor driven by said drive shaft and coaxially aligned therewith and having a longitudinal axis; a plurality of radially extending vanes slidably disposed in said rotor; a pivot pin disposed in said housing and having a longitudinal axis parallel to the axis of the rotor; a ring member pivotally disposed on said pivot pin in said housing and cooperating with said housing to form a displacement control chamber including wall means for positioning said ring member, said ring having a central axis eccentric from and parallel to the axis of said rotor, said ring cooperating with said rotor and vanes to form a plurality of pumping chambers that are successively connected to said inlet and discharge ports, pressurized fluid in said chambers creating an internal pressure force adjacent said discharge port which force is directed to establish a moment continuously in one direction on said ring about said pivot pin; spring means acting on said ring member and urging said ring member in said one direction; and pressure control valve means for pressurizing said control chamber to establish a controlled moment on said ring about said pivot means in a direction opposite to the first mentioned moment, said controlled moment being cooperable with said spring means and said wall means to control the displacement of said pump by controlling the pivotal position of the center of the ring within a quadrant defined by intersecting perpendicular lines one of which is perpendicular to the axis of the rotor and the other of which is perpendicular to both the axes of the rotor and pivot pin, said quadrant being remote from and exclusive of the pivot pin, and the center of said ring being continually noncoincident to either of the intersecting perpendicular lines defining said quadrant.

* * * * *